United States Patent [19]

De Villiers

[11] Patent Number: 4,898,390

[45] Date of Patent: Feb. 6, 1990

[54] BOARD GAME

[76] Inventor: John L. De Villiers, 20 Bridgewater, 11th Avenue, Rivonia, Transvaal, South Africa

[21] Appl. No.: 167,970

[22] Filed: Mar. 14, 1988

[30] Foreign Application Priority Data

Mar. 13, 1987 [ZA] South Africa ..... 87/1854

[51] Int. Cl.[4] ..... A63F 3/00

[52] U.S. Cl. ..... 273/249; 273/148 A

[58] Field of Search ..... 273/243, 249, 246, 148 A, 273/293, 299, 246

[56] References Cited

U.S. PATENT DOCUMENTS 1,903,744 4/1933 Heusser et al. ..... 273/148 A
2,823,919 2/1958 Scruggs ..... 273/246
3,057,623 10/1962 Barnes ..... 273/246
4,216,971 8/1980 Lyke ..... 273/243
4,682,956 7/1987 Krane ..... 273/243

*Primary Examiner*—Edward M. Coven
*Assistant Examiner*—Benjamin Layno
*Attorney, Agent, or Firm*—Burns, Doane, Swecker & Mathis

[57] ABSTRACT

A board game comrpises a playing surface constituted by a board printed with a number of graduated tracks. Markers are positioned within the tracks and cards are provided which are printed with remarks. The remarks are accessed by the players of the game with the use of assessment indicators each adapted to indicate one of a plurality of predetermined assessments of the remarks. Two different types of cards are employed. One type of card contains character attribute remarks, and the other type of card contains opinion statements.

4 Claims, 3 Drawing Sheets

BOARD GAME

BACKGROUND TO THE INVENTION

This invention relates to a board game.

SUMMARY OF THE INVENTION

According to the invention a board game comprises a playing surface demarcated with a plurality of graduated tracks, a plurality of markers, each adapted for positioning within at least one of the tracks, means to display one or more of a plurality of predetermined remarks and a plurality of assessment indicators, each adapted to indicate at least one of a plurality of a predetermined assessments of the remarks.

The remarks may be printed on a plurality of cards which, for the sake of convenience, may be stored in a card dispenser.

The card dispenser may comprise a box which is open towards the top with sides which slope towards the front of the box and a rear wall which extends above the level of cards which may, in use, be located in the box, the extended portion of the rear wall sloping rearwardly away from the box and any cards which may be located in the box, in such a manner that a card can easily be inserted between the rear wall and the rearmost card in the box.

The playing surface may conveniently comprise a printed board on which the demarcated tracks and a display area for the display of the remarks cards, are printed.

The assessment indicators may each comprise a surface on which is printed the totality of all the predetermined assessments of the remarks on the remarks cards and a cover which is movable with respect to the printed surface and formed with at least one window which is adapted, when the cover is moved relatively to the printed surface, to expose at least one assessment.

The assessment indicators may be tubular or disc shaped and adapted for manual operation. For the sake of convenience, the manually operable indicators may be provided with click-stops.

The assessment indicators may contain at least one series of assessments in which a binary choice, such as a "most-least" assessment or a "best-worst" assessment is provided and colour coded.

The remarks cards may include a class of cards containing remarks which are susceptible of a binary choice assessment of the type referred to above and the display area for this class of remarks cards may conveniently be demarcated into sectors which are coloured to correspond to the colour coding on the assessment indicators, whereby the remarks on this class of cards may be subjected to a binary choice assessment by the selection of the colour-coded assessment on the assessment indicator which corresponds best to the colours of the sectors on which the cards are placed.

DESCRIPTION OF THE DRAWINGS

The invention will be further described with reference to the accompanying drawings in which.

DESCRIPTION OF EMBODIMENTS OF THE INVENTION

Figure 1:
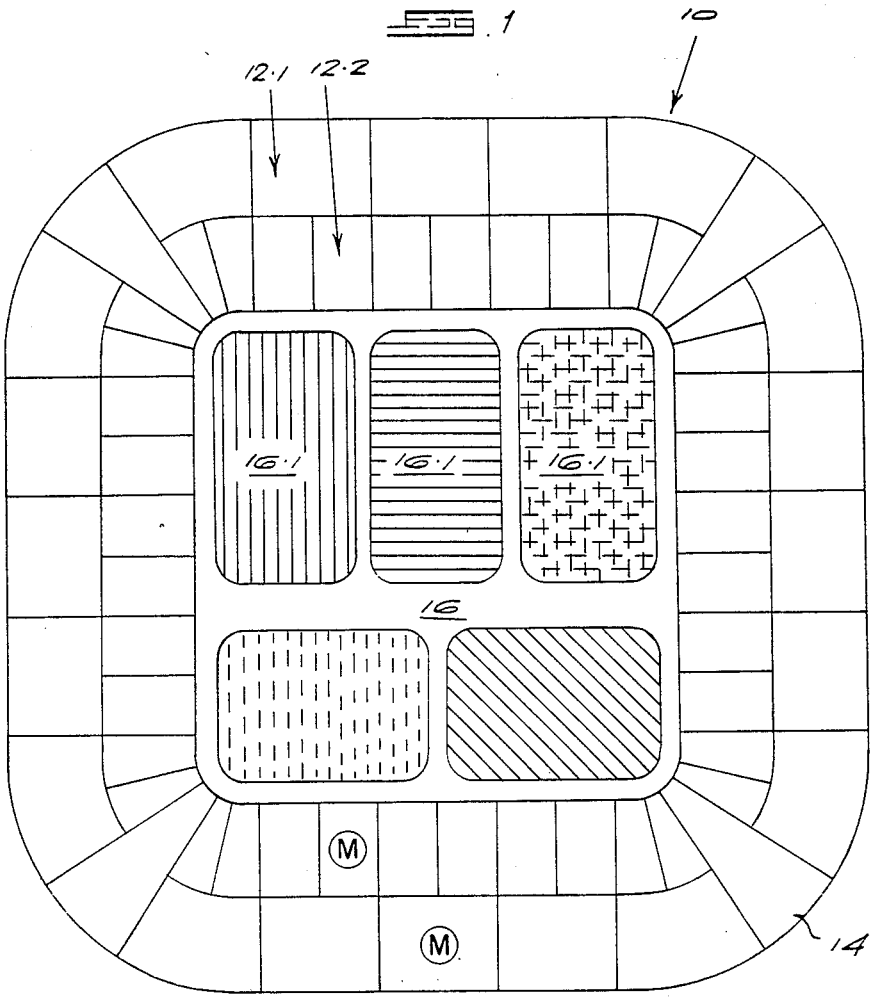
FIG. 1 is a plan view of a playing board of the board game of the invention.

The board 10 has printed thereon a plurality of tracks 12 with a start/finish area 14 and a central display area 16 for the display of a number of remarks cards 18 stored in a card dispenser 20.

Each card has a remark, statement or the like printed thereon and in one form of the game the remarks are psychological in nature. The players are required to form an assessment of the remark or remarks on the card or cards and to indicate the assessments on an assessment indicator such as those shown in FIGS. 2, 3, and 4. Each assessment indicator, essentially, comprises a display surface and a cover portion formed with a window adapted to expose the assessments on the display surface one at a time.

Figure 2:
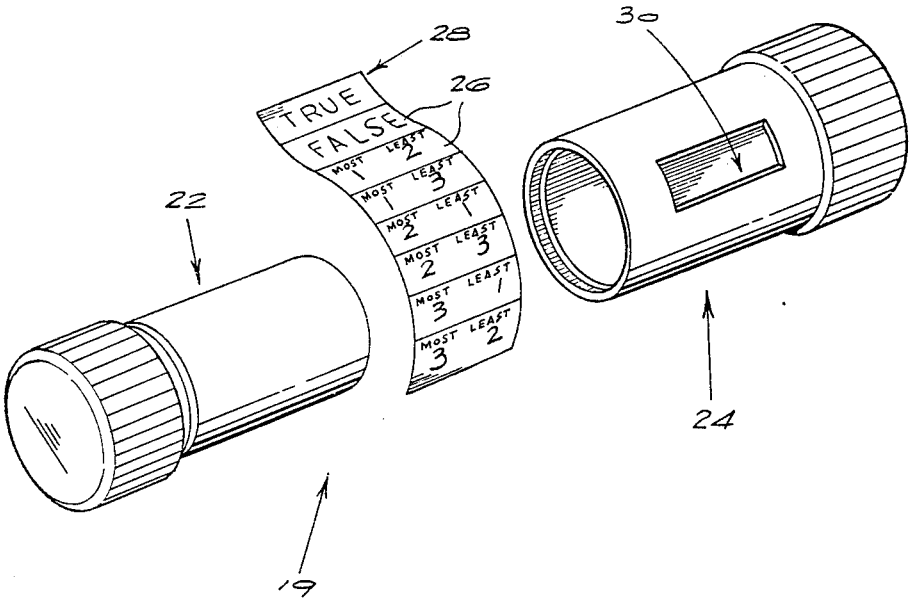
FIGS. 2, 3 and 4 are diagrammatic, isometric views of three examples of assessment indicators.

In the example shown in FIG. 2, the assessment indicator 19 is produced in two or three parts, the first part being an inner tube 22 over which an outer tube 24 is an easy slide fit. The inner part 22 has a plurality of verbal or numerical assessments printed thereon. Alternatively the assessments 26 can be printed on a separate sheet 28 which is adapted for attachment to the inner tube 22. The outer tube 24 contains a window 30 which is dimensioned to display only one of the assessments printed on the sheet 28 at a time. By rotating the outer tube 24 relatively to the inner tube 22, an assessment 26 suitable to each situation can be selected and displayed by a player.

Figure 3:
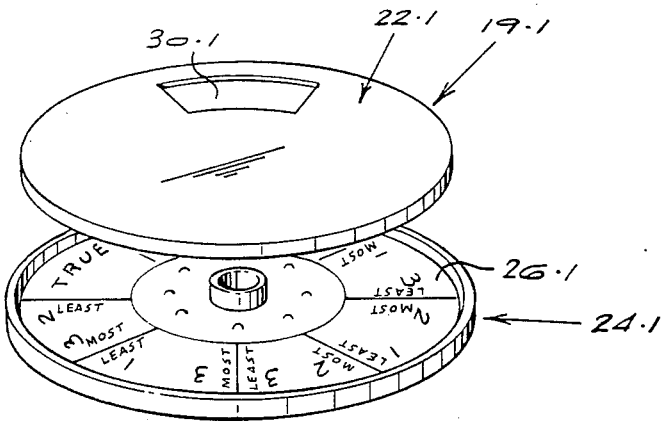

The assessment indicator 19.1 shown in FIG. 3 has a similar operation or function but uses a different configuration. It has an inner disk 22.1 rotatably mounted within an outer disk 24.1 and the inner disk 22.1 is formed with a window 30.1 through which these assessments may be displayed.

Figure 4:
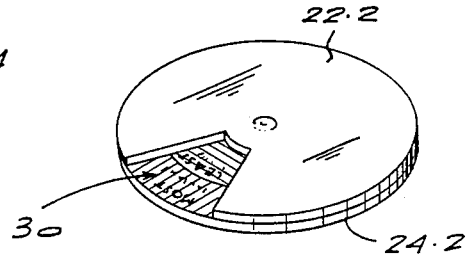
Figure 5:
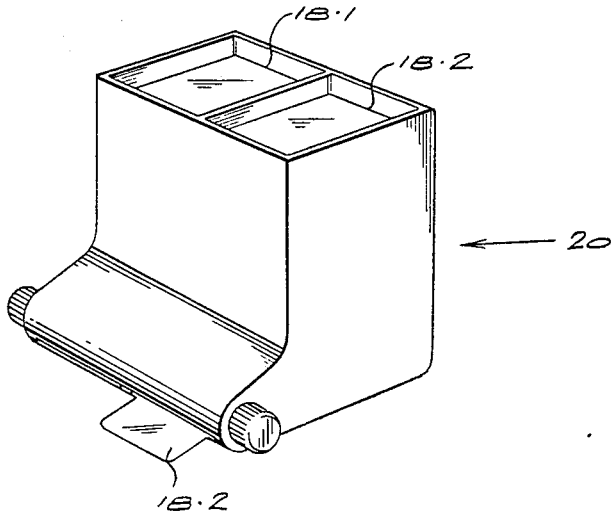
FIG. 5 is an isometric view of one example of a card dispenser.

The assessment indicator 19.2, which is shown in FIG. 4, has the same configuration as that shown in FIG. 3, but is simpler. It comprises upper and lower disks 22.2 and 24.2 which are merely mounted on the same axis,preferably by riveting. The upper disk has a window 30.2 formed therein.

In one example of the game, two sets of remarks cards 18 are loaded into the card dispenser 20, which is then placed next to the board 10. Each player selects or is allocated a track and a marker and positions the marker in the starting area 14 adjacent the selected track 12.

Using the example in which the remarks on the cards are pyschological in nature, the cards may be classified into two types, the cards in the first type 18.1 containing statements describing character attributes and those of the second type 18.2 containing statements of opinion, preference, likes, dislikes or other remarks which are capable of being subjected to a "true/false"—analysis. The first type of card 18.1 will be referred to as "character attribute cards" and the second type 18.2 as "opinion cards".

In order to allow a selection of character attributes pertaining to a particular player, the player would draw at least three character attribute cards. Each player then selects one of the character attributes which he/she considers least applicable to the particular player and one which he/she considers most applicable. For instance, a player draws three character attribute cards stating "Avaricious", "Kind", "Bland", respectively. Each player now has to select a character attribute which, in his/her opinion, is most suitable with regard to the particular player and one which is least suitable. A player could therefore select the attribute "kind" as being most suitable and the attribute "avaricious" as being least suitable, perhaps knowing that the particular player is always kind, never avaricious and sometimes rather blank. The method of indicating this could be numerical by, for instance, ranking the statements printed on the cards 18.1 and indicating this ranking by displaying, on the indicators and in order of preference, position numbers printed on the display area 16 on which the cards 18.1 are displayed for the purpose of the players forming an assessment of the statements printed on the cards. These assessments may also be expressed by using a colour-coded binary choice mechanism which will be described below.

For the opinion card 18.2, the predetermined assessments "true" or "false" are provided on the assessment indicators 19, 19.1 and 19.2.

Scores are allocated to each player in accordance with the rules of the game. The scores may, for instance, depend on the number of players arriving at similar assessments of the remarks on the character attribute card 18.1 or the same "true/false" analyses of the statements on the opinion card 18.2. Once a score has been allocated to each player the marker of the player is then advanced along the tracks 12 in dependence on the score so allocated.

Figure 6:
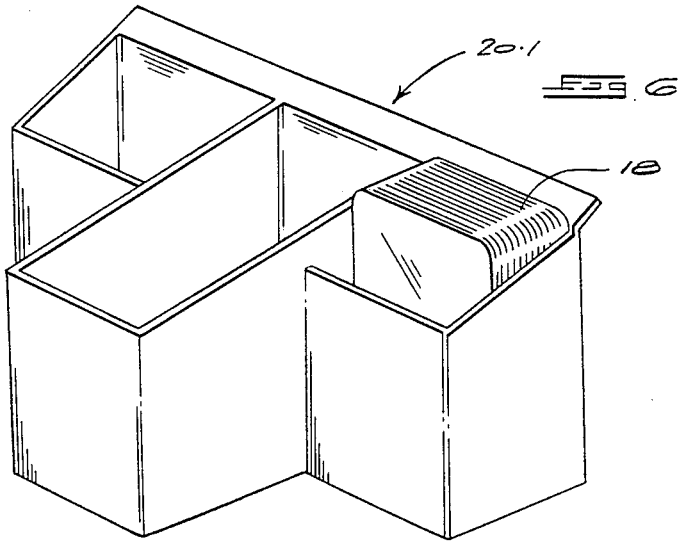
FIG. 6 is another example of a card dispenser according to the invention.

In a specific example of the game there is provided a playing board 10, a card dispenser similar to the card dispenser 20.1 shown in FIG. 6, which has sufficient divisions for three sets of cards, namely a set of character attribute cards; a set of opinion cards and a further set of opinion cards which are marked and used slightly differently from the first set of opinion cards; a set of eight indicators similar to those shown in FIG. 4; a set of tokens or markers M for moving around the board and a book of rules.

The object of the game is that players attempt to win the game by moving their marker, after starting in the start/finish block 14, around the track 12 and back into the start/finish block or area 14 ahead of the other players.

The relative scores of the players are indicated by the positions of their markers on the tracks 12 after the first player or players have moved into the start/finish block 14.

The game, in this example, could be based on the following rules:

TERMINOLOGY

Subject—This is the player to whom the cards refer during a round.

Analyst—This is any player who is not a subject.

Round—This is an assessment of a subject by players with respect to either 3 character attribute cards or EGO cards, one of the first set of opinion cards or ID cards, or an assessment of themselves with respect to one of the second set of opinion cards or a GROUP COMPATIBILITY card.

EGO Card—This is a card that contains a statement which describes a character attribute.

ID Card—This is a card that contains a statement of an opinion, a preference, a like, a dislike, a feeling or a thought.

GROUP COMPATIBILITY Card—This is a card that is similar to an ID card but has a slightly different function.

PREPARATION

The player may sit around a table or any other convenient place. The playing board is positioned centrally to the players.

The EGO cards, ID cards and GROUP COMPATIBILITY cards are shuffled separately and placed in their respective sections of the card dispenser 20.1.

Each player chooses an indicator 19 and a matching marker and positions the marker in the start area 14 on the scoring field of the board 10. A dictionary may be kept close at hand for reference during the game.

HOW THE GAME IS PLAYED

Each player in turn becomes a subject and is then analysed by the other players with respect to a statement and a set of 3 character attributes in two consecutive rounds called the "ID round" and the "EGO round" respectively.

In certain circumstances all the players get to present their personal viewpoints during the same round and this is called a "GROUP COMPATIBILITY round".

Opening—deciding who will be the first subject

Action 1—each player selects a marker and an indicator 19. The marker is placed in the Start/Finish block 14.

Action 2—Any one of the players deals one EGO card to each player from the card dispenser 20. The player who draws the card which would appear nearest the beginning of the alphabet, becomes the first subject.

Action 3—These cards are then discarded into the back of their section of the card dispenser 20.1. ID ROUND The ID round establishes whether or not a player moves in the fast (12.1) or slow (12.2) lane in the immediately following EGO round and in a GROUP COMPATIBILITY round.

Action 4—The subject then draws one ID card from the front of the ID card section of the card dispenser 20.1.

Action 5—The card is then read out aloud and is placed face side up in its appropriate position in the centre of the board where the other players can see it or refer to it.

Action 6—Each player (including the subject) then determines whether the statement on the card is true or false with respect to the subject.

Action 7—The players accordingly dial their indicators to the "True" or "False" positions and indicate their commitment to a decision by placing their indicators, face down around the playing board. This is called the "ready" position.

Players should not allow the other players to have sight of their indicators until all players have committed themselves to a decision.

Action 8—After all the players have placed their indicators in the ready position, the subject calls for them to be turned around. The players may now read the results and move their markers into either the fast or slow lanes according to scoring rule 1.

At this point a discussion may ensue. Discussions are permitted at any time during the game and there is no official limit on discussions.

EGO ROUND

The EGO round establishes what score each player gets for the "accuracy" of an assessment of the subject.

Action 9—The subject then draws three EGO cards from the front of the EGO card stack and calls these out aloud as this is done. They are placed in the appropriate coloured areas 16.1 in the centre of the board.

Action 10—Each player then decides which character attribute of the selection presented it is felt most accurately describes or fits the subject and which least accurately describes or fits the subject. The subject of course also determines which of the attributes fit himself/herself most and least.

None or all of the attributes may describe the subject with any degree of accuracy, but that is immaterial. What is important is in what order a player feels or thinks they describe the subject, given the particular range of attributes to choose from.

Action 11—All players then dial their indicators 19 to indicate their opinions or assessments by selecting the colours on the indicator to match the colours of the coloured sectors 16.1 of the display area 16 upon which the cards containing the most accurate and least accurate descriptions of the subject have been placed.

Each of the three coloured sectors 16.1 is coloured in a single different colour. To further distinguish them from each other they may be numbered 1, 2 and 3.

Each assessment position 26 on the indicators 19 displays only two of the three colours of the different sectors 16.1 on which the EGO cards have been placed. When correctly aligned, only one assessment 26 can be viewed through the window 30 (or 30.1 or 30.2). One colour (or number) will be marked "most" (i.e., most accurate description of the subject) while the other will be marked "least" (i.e., least accurate description of the subject). Each assessment 26 displays a different combination of two of the three colours marked as above.

In this manner the players can exercise a binary choice by choosing a "most"-"least" or "best"-"worst" assessment 26 whereby the colour (or number) marked "most" corresponds to the colour (or number) for the sector 16.1 on which the EGO card is placed which, in the player's opinion, represents the most accurate assessment of the subject and the colour (or number) marked "least" corresponds to the colour (or number) which represents the least accurate assessment.

Thus, if the sectors 16.1 are coloured blue, yellow and red, for example, the assessment 26 would be individually marked as:

| | |
|---|---|
| "MOST" blue | "LEAST" red |
| "MOST" yellow | "LEAST" red |
| "MOST" red | "LEAST" blue |
| "MOST" yellow | "LEAST" blue |
| "MOST" red | "LEAST" yellow |
| "MOST" blue | "LEAST" yellow |

Again it is very important that players do not see each other's indicators until every player is committed to a decision.

Action 12—When a player is committed to a decision, it is indicated by the indicator 19 being placed face down on or next to the board in the "ready" position.

Action 13—When all players are ready, the subject calls for them to turn their indicators over. The markers are then moved according to scoring rules 2 and 3.

If any player lands on one of the "GROUP COMPATIBILITY" squares after the markers are moved as a result of an EGO round, then a "GROUP COMPATIBILITY" round is played in which case Action 15 follows this action. If not, move on to Action 14.

Action 14—The subject then discards the three EGO cards and the single ID card into the card dispenser and passes the dispenser to the player on the left who becomes the next subject. Actions 3 through 18 are then repeated.

GROUP COMPATIBILITY ROUND

This round gives each player a chance to express personal feelings about the subject matter of the GROUP COMPATIBILITY card by means of an indicator and also provides an opportunity to score 1 point.

Scoring is the same as in the ID round. Players indicate either "True" or "False" assessments, but in this round there is no subject and they assess themselves with respect to a GROUP COMPATIBILITY card. Only 1 point is scored for each player whose assessment is the same as the majority of assessments, regardless of the number of players. Players with assessments in the minority do not score and if there is an even split of assessments, nobody scores.

Players remain in their respective fast or slow lanes when moving their markers during this round.

Action 15—a GROUP COMPATIBILITY round card is drawn by the subject and is read out aloud. It is then placed in the appropriate area in the centre of the playing board. The subject now ceases to be the subject.

Action 16—Each player now determines whether that statement is true or false with respect to themselves.

Action 17—When all players have made their decisions and have placed their indicators 19 in the "ready" posiiton, the indicators are turned over and each player's score is calculated according to scoring rule 4.

Action 18—The markers are then moved according to the scores and play continues from action 3.

A "GROUP COMPATIBILITY" round does not follow a "GROUP COMPATIBILITY" round. It only follows an EGO round.

The winner is the player with the highest score at the end of the game. 2nd, 3rd and 4th places and so on, are also indicated by markers in the scoring field.

NOTES

Note 1—Players consist of analysts and subjects. During an ID or an EGO round, there is only one subject but during a GROUP COMPATIBILITY round, each player is an analyst to himself/herself.

Note 2—Some of the character attributes on the EGO cards have broader slang meanings. An example of this is the word "abrasive" which in character or personality terms really approximates a combination of "aggravating, hurtful, unpleasant and harsh".

Note 3—It is important that players do not see each other's indicators until they have all committed themselves to their own assessment. If one player copies another, the player being copied loses all advantage in scoring points oer the copyist.

Note 4—Scoring involves the action of moving a marker. If a player scores 5 points, this player's marker is moved 5 blocks forward on the scoreboard, whereby the position of a marker on the board indicates a player's score.

PLAYING RULES

Scoring rule 1—A player who presents one of the following indications moves into the fast lane for the following EGO round:

a. an analyst whose indicator assessment is the same as the subject's.

b. a subject whose indicator does not present a unique assessment.

c. all analysts, if the subject indicator presents a unique assessment.

d. all other players move into the slow lane.

Scoring rule 2—Players who have returned the same assessments as each other, score the same as each other and the value of their score is equal to the total number of those who have the same assessments.

Any players with unique assessments do not score.

For Example: Assuming that there are eight players in a game, four of them agree that the SUBJECT is MOST-pink/LEAST-purple, two of them judge the SUBJECT to be MOST-pink/LEAST-yellow, the seventh player feels that the SUBJECT is MOST-purple/-LEAST yellow, and the last player decides that the SUBJECT is MOST-purple/LEAST-pink. The scores in this case would be as follows:

| Indicated Opinion | Score |
|---|---|
| MOST-pink/LEAST-purple | 4 players score 4 points each |
| MOST-pink/LEAST-yellow | 2 players score 2 points each |
| MOST-purple/LEAST-yellow | 1 player scores 0 points |
| MOST-purple/LEAST-pink | 1 player scores 0 points |

Each player with, for instance, four points moves four squares on the playing board. A player in the fast lane, then obviously moves further than a player with the same score in the slow lane.

Playing rule 1—The length of the game is determined by the numbers of players in the game—3,4 or 5 players play for 1 lap of the board, ie., a game is completed when a player reaches the Start/Finish block after going around the board once only. In the cases of 6,7 or 8 players, a game is completed when a player reaches the Start/Finish block after going around the board twice.

Playing rule 2—Discarded cards are not used again in the same game.

Playing rule 3—Players may use a dictionary at any time they please.

Playing rule 4—Any player who exposes an indicator 19 or expresses an opinion verbally or otherwise before or during actions 13 and 17 for any reason whatsoever, forfeits the score for that round. The defaulting player indicator is, however, still used for calculating the scores of the other players.

Playing rule 5—Play always moves to the left. The player to the left of the first subject becomes the second subject and so on. While it is not important in which direction the markers are moved around the board, it is however, customary to move them counterclockwise.

Playing rule 6—Only the indicators 19 may be used to present assessments and once the assessments have been exposed they may not be changed, regardless of the reason for wanting to change the assessment.

Playing rule 7—The only time a player may go from the slow lane into the fast lane during an EGO round is when that player is on the GROUP COMPATIBILITY block at the Start/Finish position 14 at the end of the game. A point is required to cross the boundary of any block or track 12 and therefore 2 points are required to go from the slow lane to the Start/Finish block while only 1 point is required from the fast lane.

I claim:

1. A board game comprising in combination:

first and second different types of remarks cards, each card of said first type containing a single remark selected from a group of character attributes, each card of said second type containing a single remark selected from a group of opinion statements, a board including a playing surface demarcated with a plurality of graduated tracks and a display area for displaying at least one card of each of said first and second sets, a plurality of assessment indicators each assessment indicator containing:

predetermined assessments pertaining to remarks on said first and second types of cards, and means for indicating selected assessments pertaining to remarks on displayed cards of said first and second types, and a plurality of markers each adapted for being positioned within graduations on at least one of said tracks.

2. A board game according to claim 1, wherein each of said assessment indicators comprises a surface on which is printed all said predetermined assessments, and a cover which is movable with respect to said printed surface and formed with at least one window adapted, when said cover is moved relative to said printed surface, to expose at least one said assessment.

3. A board game according to claim 1, wherein said display area is adapted for the display of at least three cards of said first type, and said predetermined assessments provide a binary choice of a most favorable/least favorable nature in respect of the character attribute cards on display.

4. A board game according to claim 3, wherein said display area for said character attribute cards is demarcated into sectors which are coloured to correspond to a colour coding on said assessment indicators, whereby said remarks on said first type of cards is subjected to a binary choice assessment by the selection of a colour-coded assessment on the assessment indicator which corresponds to colours of said sectors on which the cards are placed.

* * * * *